US007320176B2

(12) United States Patent
Sugiyama et al.

(10) Patent No.: US 7,320,176 B2
(45) Date of Patent: Jan. 22, 2008

(54) ASSEMBLY DEVICE OF SUPPORT MAT FOR CERAMIC CATALYST CARRIER

(75) Inventors: Yasuhiro Sugiyama, Tokyo (JP); Isao Kato, Tokyo (JP)

(73) Assignee: Calsonic Kansei Corporation, Tokyo (JP)

( * ) Notice: Subject to any disclaimer, the term of this patent is extended or adjusted under 35 U.S.C. 154(b) by 212 days.

(21) Appl. No.: 11/025,951

(22) Filed: Jan. 3, 2005

(65) Prior Publication Data

US 2005/0147708 A1 Jul. 7, 2005

(51) Int. Cl.
*B21D 51/16* (2006.01)

(52) U.S. Cl. ..... 29/890; 425/394; 425/397; 425/403.1; 425/438; 425/409

(58) Field of Classification Search ..... 425/394, 425/397, 403, 403.1, 409, 422, 438; 29/890
See application file for complete search history.

(56) References Cited

U.S. PATENT DOCUMENTS 4,513,596 A * 4/1985 Usher ..... 72/51
5,851,569 A * 12/1998 Moore et al. ..... 425/504
6,299,843 B1 * 10/2001 Locker et al. ..... 422/179
6,405,437 B1 * 6/2002 Sussmilch et al. ..... 29/890.08
6,769,281 B2 * 8/2004 Irie et al. ..... 72/121

FOREIGN PATENT DOCUMENTS

| | | | |
|---|---|---|---|
| EP | 1344911 | A1 | 9/2003 |
| JP | 10-131744 | A | 5/1998 |
| JP | 2000-288846 | A | 10/2000 |
| JP | 2001-303944 | A | 10/2001 |
| JP | 2002-263764 | A | 9/2002 |
| WO | WO 99/14119 | A2 | 3/1999 |

* cited by examiner

*Primary Examiner*—Yogendra N. Gupta
*Assistant Examiner*—Maria Veronica Ewald
(74) *Attorney, Agent, or Firm*—Foley & Lardner LLP

(57) ABSTRACT

An assembly device includes: a push-in unit provided in a vertically movable tool base to push a ceramic catalyst carrier together with a support mat into a recession of a shaping die; a first and second pressing units for pressing both end portions of the mat from side faces to curve them along an arc-shaped upper surface of the carrier; pressure rollers provided at the both pressing units to press the both end portions toward the carrier; a tape presser in the push-in unit for pressing an adhesive tape to an upper surfaces of engagement portions of the depression and projection in a gap formed between the both rollers and operating with the push-in unit in pushing the carrier and mat into the recession of the shaping die; and a push-up unit provided on a bottom of the recession to push up the carrier and mat.

18 Claims, 6 Drawing Sheets

ASSEMBLY DEVICE OF SUPPORT MAT FOR CERAMIC CATALYST CARRIER

BACKGROUND OF THE INVENTION

1. Field of the Invention

The present invention relates to an assembly device automatically assembling a support mat to a ceramic catalyst carrier used in an exhaust system of a combustion engine of a motor vehicle, and others.

2. Description of the Related Art

A ceramic catalyst carrier with a support mat of a prior art is disclosed in Japanese Patent Application Laid-open No. Hei 10-131744. The ceramic catalyst carrier carrying a catalyst is wound around an outer periphery thereof with a metal support mat and the carrier with the support mat is housed in a container that constitutes a part of an exhaust passage of an exhaust system of a combustion engine. FIG. 5A shows a process chart illustrating plane viewed states of the support mat 101 and the ceramic catalyst carrier 103 in three steps of an assembly procedure of them, and FIG. 5B shows a process chart illustrating front viewed states of them corresponding to the steps of FIG. 5A.

As shown in FIG. 5A and FIG. 5B, the support mat 101 is assembled to a ceramic catalyst carrier 103 by using a jig 102 having a recession 102 with a semicircular cross section. Their assembly is performed by the following procedure below. First, a rectangular metal plate to be the support mat 101 and the ceramic catalyst carrier 103 are prepared. This support mat 101 is formed to have a main body, and engagement portions consisting of a depression 101*a* and a projection 101*b* that are provided in of the main body at both end portions in a winding direction of thereof, respectively, and can be fitted together with each other. The above formed support mat 101 is placed on the jig 102, and then the ceramic catalyst carrier 103 is pushed into the recession 102*a* of the jig 102, pressing the support mat 101 toward the recession 101 to deform a intermediate portion thereof, so that the intermediate portion of the support mat 101 is formed to curve along an arc-shaped bottom surface of the ceramic catalyst carrier 103. Then, the both end portions of the support mat 101, which are brought into a substantially perpendicularly standing state when the ceramic catalyst carrier 103 is pushed into the recession 102*a*, are pressed from both side portions thereof to approach each other so that the both end portions are curved along an arc-shaped upper surface of the ceramic catalyst carrier 103.

An adhesive seal 104 is pasted on the engagement portions where the depression 101*a* and the projection 101*b* are engaged with each other, to thereby tentatively join the both end portions of the support mat 101. Then, the ceramic catalyst carrier 103 having the support mat 101 assembled around the outer periphery thereof is taken out of the recession 102*a* of the jib 102. All these processes have been manually carried out.

However, since many work processes have been all manually carried out as described above in the prior art, work efficiency is poor and in addition, undesirable variations tend to occur occasionally in positioning accuracy when the support mat 101 is assembled to the ceramic catalyst carrier 103 and in the position and state of the pasted adhesive seal 104. This has posed problems that the support mat 101 may be poorly fitted to stick its part out of the container, the adhesive seal 104 may peel off or be tucked into the container, and other problems may occur when the assembled body is press-fitted in a container in a subsequent process.

It is an object of the present invention to provide an assembly device of a support mat for a ceramic catalyst carrier that is capable of improving work efficiency by automating many assembly processes and capable of enhancing positioning accuracy in assembling the support mat to the ceramic catalyst carrier, thereby preventing poor conditions that may possibly occur when the ceramic catalyst carrier with the support mat is press-fitted in a container constituting part of an exhaust passage of an exhaust system of a combustion engine.

SUMMARY OF THE INVENTION

An assembly device of a support mat for a ceramic catalyst carrier of the first present invention includes: a base capable of holding a support mat in a flat plate shape substantially horizontally, the support mat having in both end portions a depression and a projection engageable with the depression; a shaping die provided on an intermediate portion of the base and having a recession that has a shape substantially fining a semicircular bottom surface of the ceramic catalyst carrier; an automatic tape feeder to feed an adhesive tape to an upper surface of one end portion of the base; a tape/support mat pressing unit that presses one end portion of the support mat toward the adhesive tape while the end portion of the support mat is placed on an upper surface of the adhesive tape, thereby sticking the adhesive tape to the end portion; a tool base provided above the shaping die and driven by a first actuator to be vertically movable; a push-in unit provided in the tool base and driven by a second actuator to be capable of pushing the ceramic catalyst carrier together with the support mat into the recession of the shaping die; a first pressing unit and a second pressing unit that are provided in the tool base and that are driven by a third actuator and a fourth actuator to press both end portions of the support mat from side faces so as to curve the both end portions of the support mat along an arc-shaped upper surface of the ceramic catalyst carrier; pressure rollers provided at tip portions of the first pressing unit and the second pressing unit respectively to be vertically turnable and biased by biasing members so as to press the both end portions of the support mat toward the ceramic catalyst carrier; a tape presser that is independently disposed in an intermediate portion of the push-in unit and that is driven by a fifth actuator to press the adhesive tape to an upper surfaces of engagement portions of the depression and the projection of the support mat in a gap formed between the both pressure rollers and to operate concurrently with the push-in unit in pushing the ceramic catalyst carrier together with the support mat into the recession of the shaping die; a pushup unit provided on a bottom of the recession of the shaping die and driven by a sixth actuator to be capable of pushing up the ceramic catalyst carrier together with the support mat, and a main body formed to have a substantially L-shaped cross section having a horizontal surface and a vertical surface.

An assembly device of a support mat for a ceramic catalyst carrier of the second present invention includes: a base capable of holding a support mat in a flat plate shape substantially horizontally, the support mat having in both end portions a depression and a projection engageable with the depression; a shaping die provided on an intermediate portion of the base and having a recession that has a shape substantially fitting a semicircular bottom surface of the ceramic catalyst carrier; an automatic tape feeder to feed an adhesive tape to an upper surface of one end portion of the base; a tape/support mat pressing unit that presses one end portion of the support mat toward the adhesive tape while the end portion of the support mat is placed on an upper surface of the adhesive tape, thereby sticking the adhesive tape to the end portion; a tool base provided above the shaping die and driven by a first actuator to be vertically movable; a push-in unit provided in the tool base and driven by a second actuator to be capable of pushing the ceramic catalyst carrier together with the support mat into the recession of the shaping die; a first pressing unit and a second pressing unit that are provided in the tool base and that are driven by a third actuator and a fourth actuator to press both end portions of the support mat from side faces so as to curve the both end portions of the support mat along an arc-shaped upper surface of the ceramic catalyst carrier; pressure rollers provided at tip portions of the first pressing unit and the second pressing unit respectively to be vertically turnable and biased by biasing members so as to press the both end portions of the support mat toward the ceramic catalyst carrier; a tape presser that is independently disposed in an intermediate portion of the push-in unit and that is driven by a fifth actuator to press the adhesive tape to an upper surfaces of engagement portions of the depression and the projection of the support mat in a gap formed between the both pressure rollers and to operate concurrently with the push-in unit in pushing the ceramic catalyst carrier together with the support mat into the recession of the shaping die; and a push-up unit provided on a bottom of the recession of the shaping die and driven by a sixth actuator to be capable of pushing up the ceramic catalyst carrier together with the support mat, wherein the upper surface on the base is formed as a flat surface to the support mat.

An assembly device of a support mat for a ceramic catalyst carrier of the third present invention includes: a base capable of holding a support mat in a flat plate shape substantially horizontally, the support mat having in both end portions a depression and a projection engageable with the depression; a shaping die provided on an intermediate portion of the base and having a recession that has a shape substantially fitting a semicircular bottom surface of the ceramic catalyst carrier; an automatic tape feeder to feed an adhesive tape to an upper surface of one end portion of the base; a tape/support mat pressing unit that presses one end portion of the support mat toward the adhesive tape while the end portion of the support mat is placed on an upper surface of the adhesive tape, thereby sticking the adhesive tape to the end portion; a tool base provided above the shaping die and driven by a first actuator to be vertically movable; a push-in unit provided in the tool base and driven by a second actuator to be capable of pushing the ceramic catalyst carrier together with the support mat into the recession of the shaping die; a first pressing unit and a second pressing unit that are provided in the tool base and that are driven by a third actuator and a fourth actuator to press both end portions of the support mat from side faces so as to curve the both end portions of the support mat along an arc-shaped upper surface of the ceramic catalyst carrier; pressure rollers provided at tip portions of the first pressing unit and the second pressing unit respectively to be vertically turnable and biased by biasing members so as to press the both end portions of the support mat toward the ceramic catalyst carrier; a tape presser that is independently disposed in an intermediate portion of the push-in unit and that is driven by a fifth actuator to press the adhesive tape to an upper surfaces of engagement portions of the depression and the projection of the support mat in a gap formed between the both pressure rollers and to operate concurrently with the push-in unit in pushing the ceramic catalyst carrier together with the support mat into the recession of the shaping die; and a push-up unit provided on a bottom of the recession of the shaping die and driven by a sixth actuator to be capable of pushing up the ceramic catalyst carrier together with the support mat, wherein a lower surface of the push-in unit has an arc shape fitting the arc-shaped upper surface of the ceramic catalyst carrier.

The assembly device of the support mat for the ceramic catalyst carrier of the present invention assembles the support mat to the ceramic catalyst carrier in the following order.

(a) The automatic tape feeder feeds an adhesive tape onto an upper surface of one end portion of the base.

(b) The flat-plate-shaped support mat is placed on the base. At this time, the support mat is placed so that one of the depression and the projection formed in the both end portions of the support mat overlaps an upper surface of the adhesive tape.

(c) The tape/support mat pressing unit presses the end portion of the support mat toward the adhesive tape so that the adhesive tape sticks to the end portion.

(d) The push-up unit is moved up by the sixth actuator to support a bottom of the support mat, and the tool base is moved down by the first actuator to bring the push-in unit and the tape presser into contact with the upper surface of the ceramic catalyst carrier placed on the upper surface of the support mat. In this state, the push-up unit is moved down by the sixth actuator and at the same time, the tape presser and the push-in unit are both moved down by the fifth actuator and the second actuator to push the ceramic catalyst carrier together with the support mat into the recession of the shaping die, so that an intermediate portion of the support mat curves along the arc-shaped bottom surface of the ceramic catalyst carrier and the both end portions of the support mat are brought into a substantially perpendicularly standing state.

(e) The tape presser and the push-in unit are both moved up by the fifth actuator and the second actuator.

(f) The first pressing unit and the second pressing unit driven by the third actuator and the fourth actuator press the both end portions of the support mat from the side faces so that the both end portions are curved along the arc-shaped upper surface of the ceramic catalyst carrier. At this time, the pressure rollers press the support mat while rolling. The pressure rollers are provided in the tip portions of the first pressing unit and the second pressing unit respectively to be vertically turnable and are biased by the biasing members so as to press the both end portions of the support mat toward the ceramic catalyst carrier. As a result of thus pressing the both end portions of the support mat by the pressure rollers, the both end portions can be naturally curved in an arc shape to fit the arc-shaped upper surface of the ceramic catalyst carrier.

(g) The pressing unit driven by the second actuator presses the adhesive tape to the upper surfaces of the engagement portions of the depression and the projection of the support mat in a gap formed between the both pressure rollers. Consequently, the depression and the projection formed in the both ends of the support mat are tentatively joined in the engaged state.

(h) The first pressing unit and the second pressing unit are moved back by the third actuator and the fourth actuator.

(i) The tape presser is moved down by the fifth actuator to press the vicinity of the engagement portions of the depression and the projection together with the adhesive tape onto the upper surface of the ceramic catalyst carrier, thereby finishing the assembly. Consequently, the whole vicinity of the engagement portions of the depression and the projection together with the adhesive tape can be surely curved along the arc-shaped upper surface of the ceramic catalyst carrier.

(j) The tape presser and the push-in unit are moved up by the fifth actuator and the second actuator, and at the same time, the push-up unit is moved up by the sixth actuator, so that the ceramic catalyst carrier having the support mat assembled around the outer periphery thereof is pushed out of the recession of the shaping die.

(k) The tool base is moved up by the first actuator and the ceramic catalyst carrier having the support mat assembled thereto is taken out of the device.

The assembly device of the support mat for the ceramic catalyst carrier can provide the following effects. Work efficiency can be improved as a result of automating many assembly processes. Further, positioning accuracy in assembling the support mat to the ceramic catalyst carrier can be enhanced, thereby preventing the occurrence of poor conditions that may possibly occur when the assembled body is press-fitted into a container constituting part of an exhaust passage.

BRIEF DESCRIPTION OF THE DRAWINGS

The objects, features and advantages of the present invention will become apparent as the description proceeds when taken in conjunction with the accompanying drawings, in which.

DETAILED DESCRIPTION OF THE PREFERRED EMBODIMENTS

Hereinafter, embodiments of the present invention will be described with the accompanying drawings.

An assembly device of a support mat for a ceramic catalyst carrier according to a first embodiment will be described with reference to the accompanying drawings of FIGS. 1 to 3.

Figure 1:
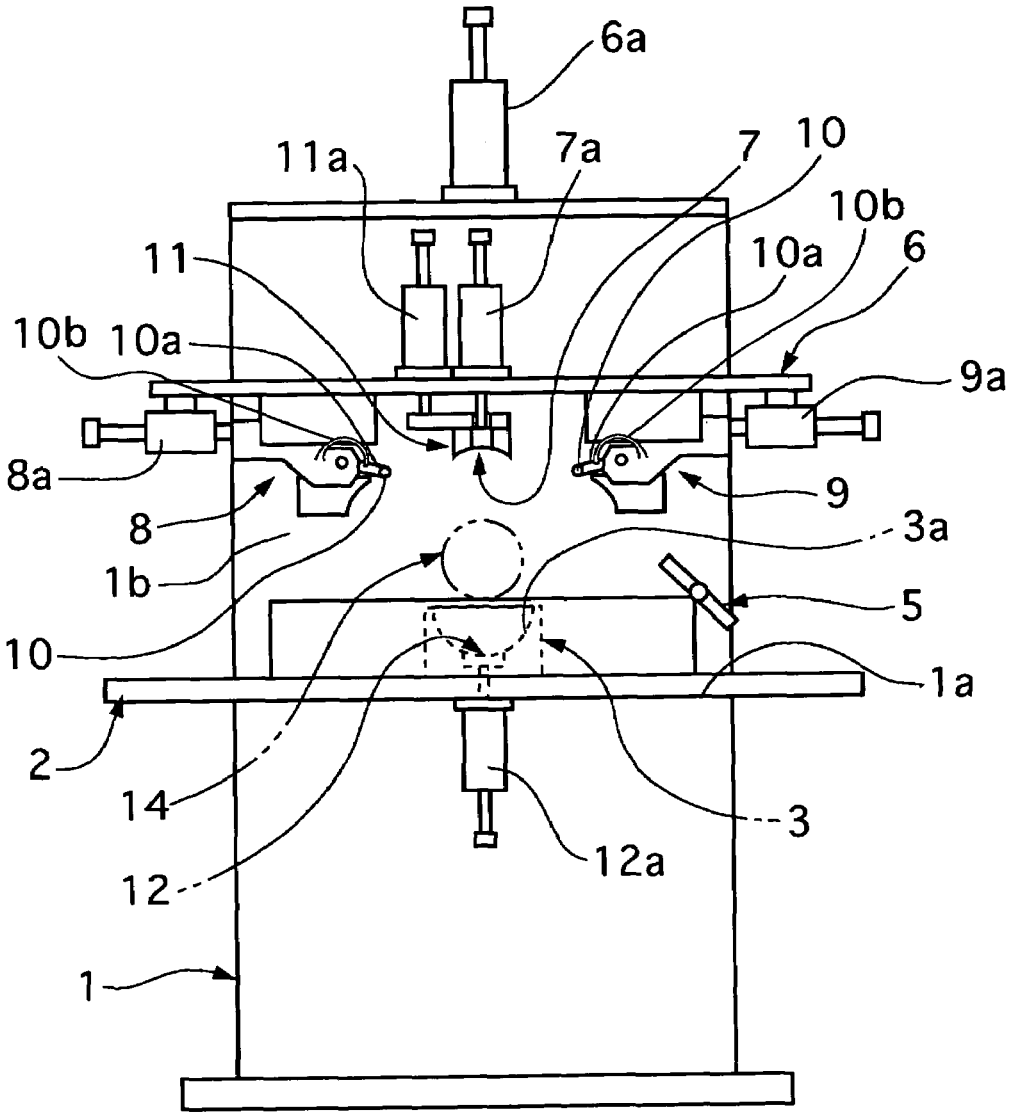
FIG. 1 is a front view showing an assembly device of a support mat for a ceramic catalyst carrier according to a first embodiment of the present invention.
Figure 2:
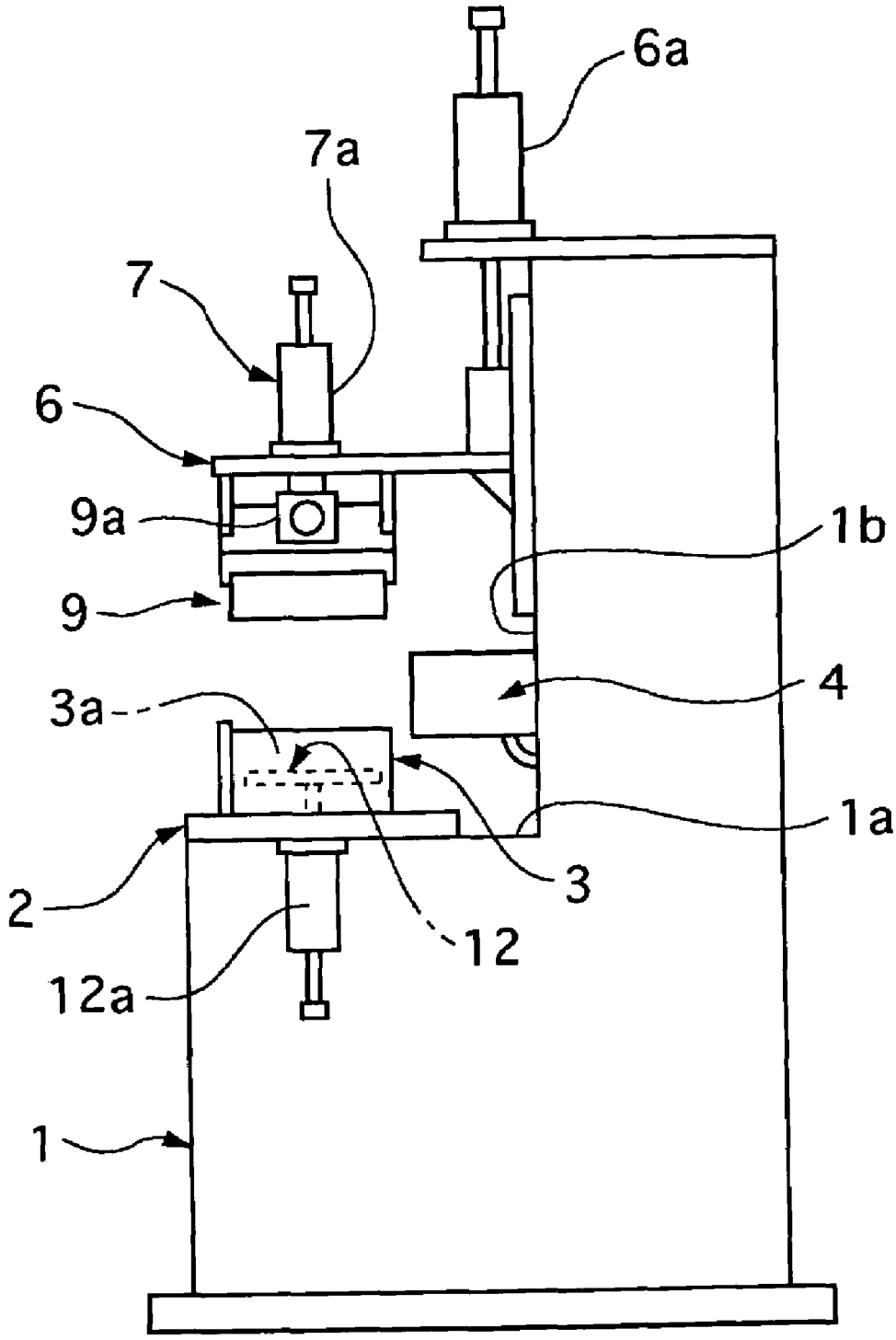
FIG. 2 is a right side view showing the assembly device of the support mat for the ceramic catalyst carrier according to the first embodiment shown in FIG. 1.
Figure 3:
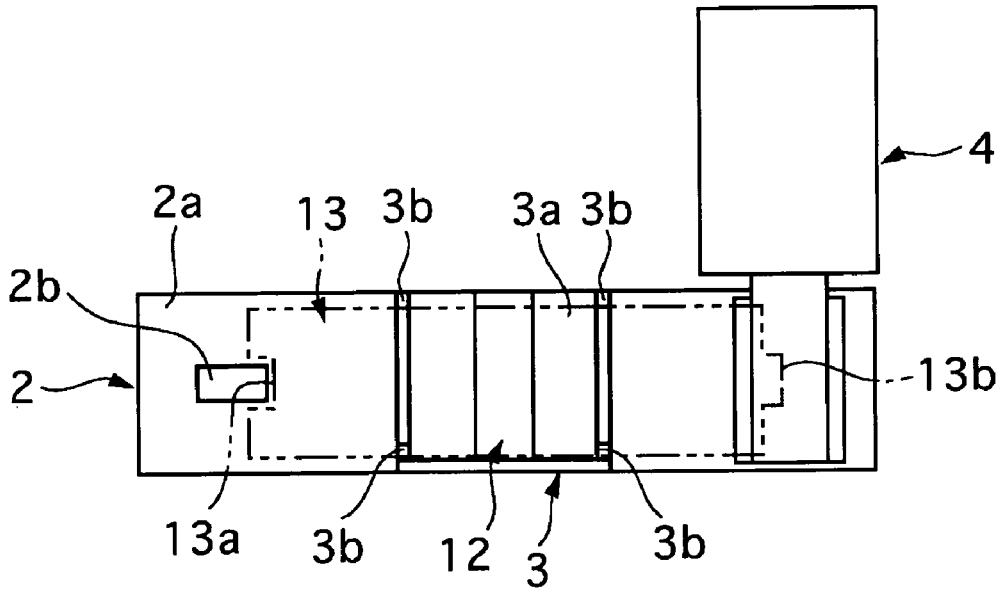
FIG. 3 is a plane view of a base of the assembly device of the support mat for the ceramic catalyst carrier according to the first embodiment shown in FIG. 1.

FIG. 1 is a front view showing the assembly device of the support mat for the ceramic catalyst carrier according to the first embodiment, FIG. 2 is a right side view of the same, and FIG. 3 is a plane view of a base thereof.

The assembly device of the support mat 13 for the ceramic catalyst carrier 14 includes a device main body 1, a base 2, a shaping die 3, an automatic tape feeder 4, a tape/support mat pressing unit 5, a tool base 6, a push-in unit 7, a first pressing unit 8, a second pressing unit 9, pressure rollers 10, a tape presser 11, and a push-up unit 12.

The device main body 1 is formed to have a substantially L-shaped cross section, with a horizontal surface 1*a* and a vertical surface 1*b*.

The base 2 is fixedly positioned on the horizontal surface 1*a* of the device main body 1 and its upper surface is formed as a flat surface 2*a* capable of holding a support mat 13 in a substantially horizontal state. The support mat 13 is formed in a rectangular shape, having a length long enough to be wound around an outer peripheral surface of a ceramic catalyst carrier 14 in a column shaped. Further, the support mat 13 has in both longitudinal end portions thereof a square-shaped depression 13*a* and a projection 13*b* engageable with the depression 13*a*, as shown in FIG. 3.

The shaping die 3 is provided on an intermediate portion of the base 2 and has in an upper surface thereof a recession 3*a* having a shape substantially fitting a semicircular bottom surface of the ceramic catalyst carrier 14.

The automatic tape feeder 4 is a device for feeding an adhesive tape onto an upper surface of one end portion, corresponding to a right end portion in FIG. 1, of the base 2 and it is fixedly positioned on the vertical surface 1*b* of the device main body 1. Since the automatic tape feeder 4 is a known technique, the structure thereof will not be detailed. Further, the upper surface of the base 2 onto which the adhesive tape is fed is coated with silicon, Teflon, or the like for adhesion prevention.

The tape/support mat pressing unit 5 presses one end portion of the support mat 13 placed on an upper surface of the adhesive tape toward the adhesive face of the adhesive tape 15 so that the adhesive tape sticks to this one end portion. The tape/support mat pressing unit 5 is turnably disposed in one end portion, corresponding to a right end portion in FIG. 1, of the base 2.

The tool base 6 is disposed above the shaping die 3 to be vertically movable along the vertical surface 1*b* of the device main body 1. The tool base 6 is driven in a vertical direction by a first hydraulic cylinder 6*a* provided in the device main body 1. The first hydraulic cylinder 6*a* acts as a first actuator of the present invention.

The push-in unit 7 is provided in the tool base 6 to be vertically movable, and it has a function of pushing the ceramic catalyst carrier 14, which is placed on an upper surface of the support mat 13 placed on the upper surface of the base 2, into the recession 3*a* of the shaping die 3 together with the support mat 13. A lower surface of the push-in unit 7 has an arc shape fitting an arc-shaped upper surface of the ceramic catalyst carrier. The push-in unit 7 is driven in a direction perpendicular to the tool base 6 by a second hydraulic cylinder 7*a* provided in the tool base 6. The second hydraulic cylinder 7*a* acts as a second actuator of the present invention.

The first pressing unit 8 and the second pressing unit 9 are provided on the tool base 6 to press the both end portions of the support mat 13 from side faces so that the both end portions of the support mat 13 are curved along the arc-shaped upper surface of the ceramic catalyst carrier 14. The first pressing unit 8 and the second pressing unit 9 are horizontally driven toward the ceramic catalyst carrier 14 by a third hydraulic cylinder 8*a* and a fourth hydraulic cylinder 9*a* respectively. The third hydraulic cylinder 8*a* acts as a third actuator of the present invention, and the fourth hydraulic cylinder 9*a* acts as a fourth actuator of the present invention.

The pressure rollers 10 are turnably provided in tip portions of arms 10*a* which are provided in respective tip portions of the first pressing unit 8 and the second pressing unit 9 to be vertically turnable. The pressure rollers 10 are biased by pressure springs 10*b* so as to press the both end portions of the support mat 13 toward the ceramic catalyst carrier 13. The pressure springs 10*b* act as biasing members of the present invention.

The tape presser 11 is independently disposed in an intermediate portion of the push-in unit 7. The tape presser 11 has a function of pressing the adhesive tape to an upper surfaces of engagement portions of the depression 13*a* and the projection 13*b* of the support mat 13 in a gap formed between the both pressure rollers 10, 10, as well as having a function of operating concurrently with the push-in unit 7 to push the ceramic catalyst carrier 14 together with the support mat 13 into the recession 3*a* of the shaping die 3. The tape presser 11 is driven in the direction perpendicular to the tool base 6 by a fifth hydraulic cylinder 11*a* provided in the tool base 6. The fifth hydraulic cylinder 11*a* acts as a fifth actuator of the present invention.

The push-up unit 12 is provided on a bottom of the recession 3*a* of the shaping die 3 and it pushes up the ceramic catalyst carrier 14 together with the support mat 13. The push-up unit 12 is vertically driven by a sixth hydraulic cylinder 12*a* provided in the base 2. The sixth hydraulic cylinder 12*a* acts as a sixth actuator of the present invention.

The base 2 has a locking protrusion 2*b* for positioning the support mat 13 placed thereon. The locking protrusion 2*b* is fitted in the depression 13*a* of the support mat 13 to position the depression 13*a* side end portion of the support mat 13.

Positioning protrusions 3*b* are protrudingly formed at respective four corners of an upper periphery of an opening of the recession 3*a* of the shaping die 3, and they are intended for width-direction positioning of an intermediate portion of the support mat 13.

Next, the operations and effects of the assembly device according to the first embodiment will be described.

In the assembly device of the first embodiment, the assembly of the support mat 13 to the ceramic catalyst carrier 14 follows the procedure below.

(a) First, the automatic tape feeder 4 feeds the adhesive tape onto the upper surface of one end portion of the base 2.

(b) Next, the support mat 13 in a flat plate shape is placed on the base 2. At this time, the depression 13*a* formed in one end portion of the support mat 13 is locked by the locking protrusion 2*b* for positioning, and the intermediate portion of the support mat 13 is inserted in an area surrounded by the positioning protrusions 3*b* which are protrudingly formed at the respective four corners of the upper periphery of the opening of the recession 3*a* of the shaping die 3, and is locked by the positioning protrusions 3*b*, so that the depression 13*a* side end portion of the support mat 13 and the intermediate portion thereof are positioned in terms of width and longitudinal directions. As a result of this positioning, the projection 13*b* formed in the other end portion of the support mat 13 overlaps the upper surface of the adhesive tape.

(c) Next, the tape/support mat pressing unit 5 presses the end portion of the support mat 13 toward the adhesive tape, so that the adhesive tape sticks to this end portion.

(d) Next, the push-up unit 12 is moved up by the sixth hydraulic cylinder 12*a* to support the bottom of the support mat 13, and at the same time, the tool base 6 is moved down by the first hydraulic cylinder 6*a* to bring the push-in unit 7 and the tape presser 11 into contact with the upper surface of the ceramic catalyst carrier 14 placed on the upper surface of the support mat 13. In this state, the push-up unit 12 is moved down by the sixth hydraulic cylinder 12*a* and at the same time, the tape presser 11 and the push-in unit 7 are moved down by the fifth hydraulic cylinder 11*a* and the second hydraulic cylinder 7*a* to push the ceramic catalyst carrier 14 together with the support mat 13 into the recession 3*a* of the shaping die 3. As a result, the intermediate portion of the support mat 13 is curved along the arc-shaped bottom surface of the ceramic catalyst carrier 14 and the both end portions of the support mat 13 are brought into a substantially perpendicularly standing state.

(e) Next, the tape presser 11 and the push-in unit 7 are both moved up by the fifth hydraulic cylinder 11*a* and the second hydraulic cylinder 7*a*, respectively.

(f) Next, the first pressing unit 8 and the second pressing unit 9 respectively driven by the third hydraulic cylinder 8*a* and the fourth hydraulic cylinder 9*a* press the both end portions of the support mat 13 from the side faces so that the end portions are curved along the arc-shaped upper surface of the ceramic catalyst carrier 14. At this time, the support mat 13 is pressed by the rolling pressure rollers 10, 10 which are provided in the respective tip portions of the first pressing unit 8 and the second pressing unit 9 to be vertically turnable and which are biased by the pressure springs to press the both end portions of the support mat 13 toward the ceramic catalyst carrier 14. As a result of pressing the both end portions of the support mat 13 by the pressure rollers 10, 10, the both end portions can be naturally curved in an arc shape to fit the arc-shaped upper surface of the ceramic catalyst carrier 14.

(g) Next, the push-in unit 7 driven by the second hydraulic cylinder 7*a* presses the adhesive tape to the upper surfaces of the engagement portions of the depression 13*a* and the projection 13*b* of the support mat 13 in the gap formed between the both pressure rollers 10, 10. Consequently, the depression 13*a* and the projection 13*b* formed in the both ends of the support mat 13 are tentatively joined in an engaged state by the adhesive tape.

(h) Next, the first pressing unit 8 and the second pressing unit 9 are moved back by the third hydraulic cylinder 8*a* and the fourth hydraulic cylinder 9*a*, respectively.

(i) Next, the tape presser 11 is moved down by the fifth hydraulic cylinder 11*a* to press the vicinity of the engagement portions of the depression 13*a* and the projection 13*b* together with the adhesive tape to the upper surface of the ceramic catalyst carrier 14, thereby finishing the assembly. Consequently, the entire vicinity of the engagement portions of the depression 13*a* and the projection 13*b* together with the adhesive tape can be surely curved along the arc-shaped upper surface of the ceramic catalyst carrier 14.

(j) Next, the tape presser 11 and the push-in unit 7 are moved up by the fifth hydraulic cylinder 11*a* and the second hydraulic cylinder 7*a* respectively, and at the same time, the push-up unit 12 is moved up by the sixth hydraulic cylinder 12*a* to push the ceramic catalyst carrier 14 having the support mat 13 assembled around the outer periphery thereof out of the recession 3*a* of the shaping die 3.

(k) Finally, the tool base 6 is moved up by the first hydraulic cylinder 6*a*, and the ceramic catalyst carrier 14 having the support mat 13 assembled thereto is taken out of the device.

The above constructed assembly device of the support mat 13 for the ceramic catalyst carrier 14 can provide the following effects. Work efficiency can be improved as a result of automating many assembly processes, and positioning accuracy in assembling the support mat 13 to the ceramic catalyst carrier 14 can be enhanced, thereby preventing poor conditions that may possibly occur when the assembled body is press-fitted into a container constituting part of an exhaust passage of an exhaust system of an engine.

Next, a second embodiment will be described with reference to the accompanying drawing of FIG. 4. In this embodiment, the same constituent elements as those of the first embodiment will not be shown in the drawing, or are denoted by the same reference numerals or symbols but are not described. Only what are different will be described.

The assembly device of the second embodiment has the same structure as that of the first embodiment except that the position of the automatic tape feeder 4 is changed.

Figure 4:
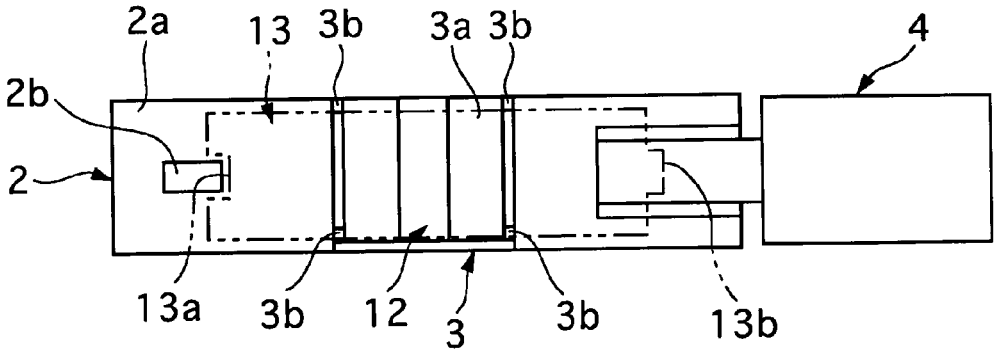
FIG. 4 is a plane view of a base in an assembly device of a support mat for a ceramic catalyst carrier according to a second embodiment of the present invention.
Figure 5A:
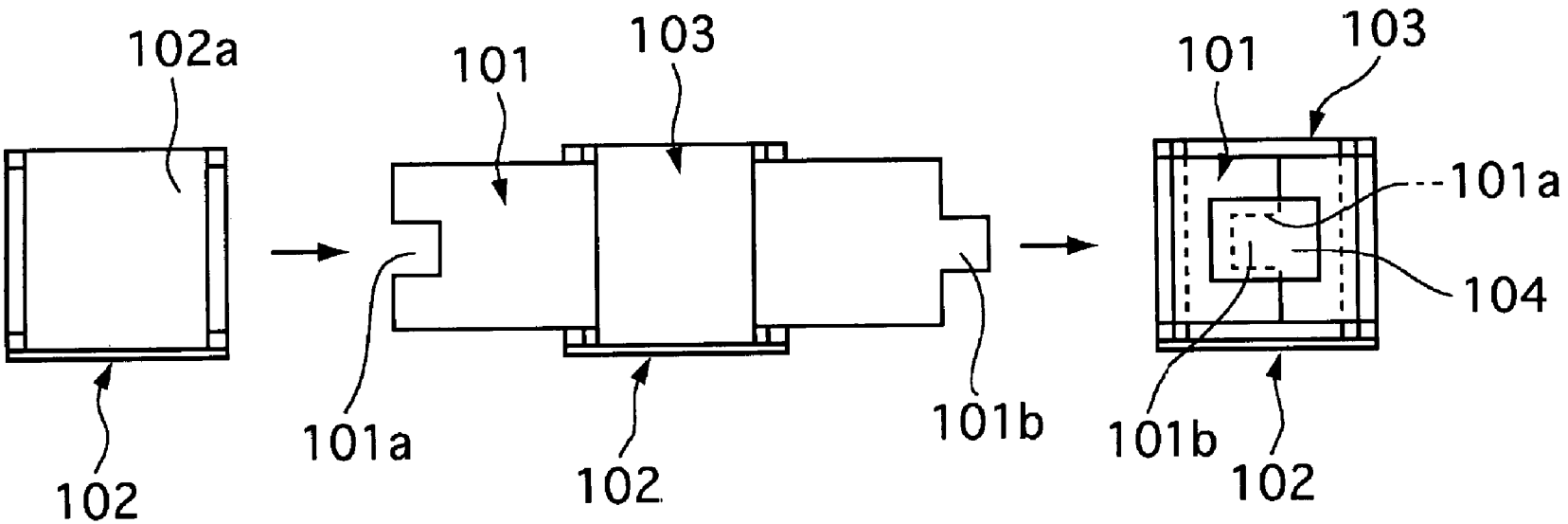
FIG. 5A PRIOR ART
FIG. 5A and FIG. 5B are process charts showing plane and front viewed states of support mat and the ceramic catalyst carrier in steps of an assembly procedure of them, using a jig in a prior art.
Figure 5B:
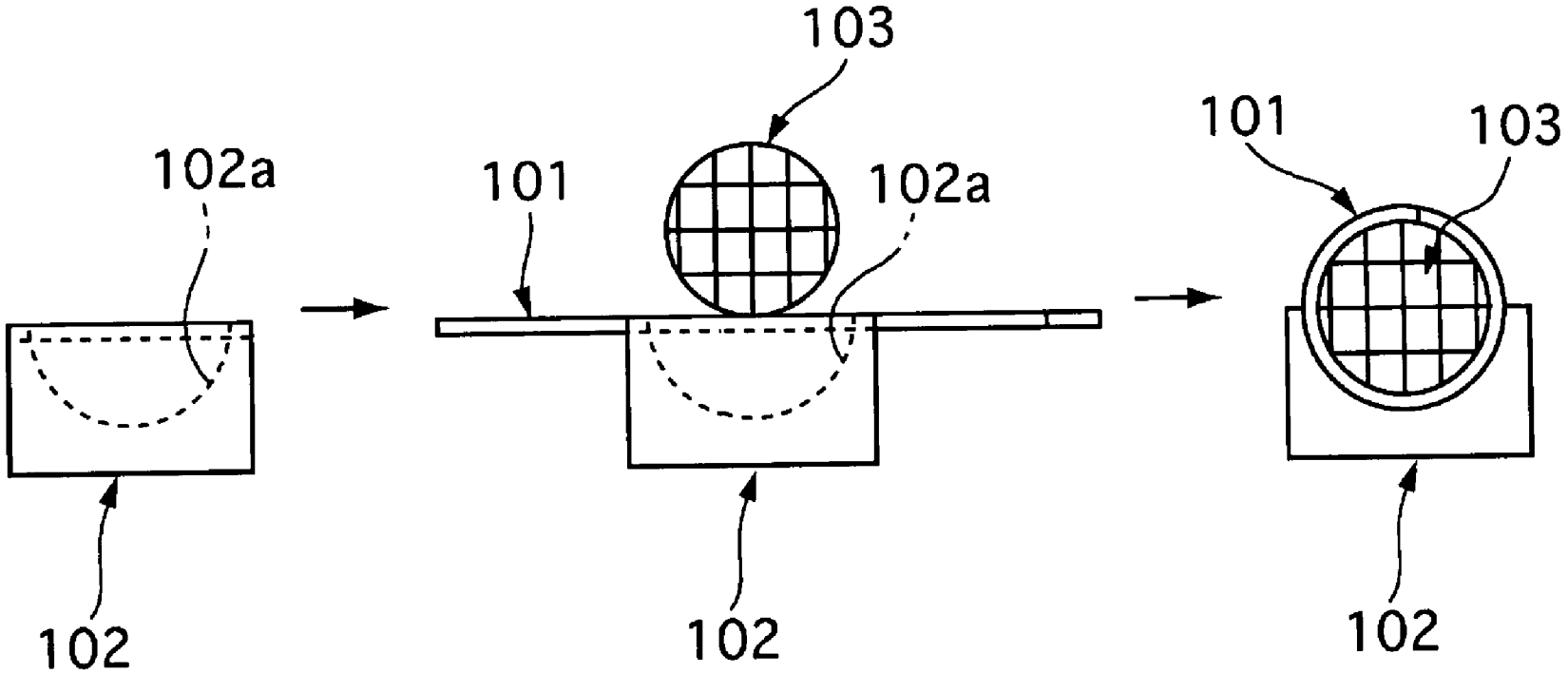
FIG. 5B PRIOR ART

Specifically, the assembly device of the second embodiment is different from that of the first embodiment in that the adhesive tape is fed from an end side of the base 2, as shown in the plane view in FIG. 4.

Hitherto, the embodiments have been described, but the present invention is not limited to the embodiments described above and any design modification and so on without departing from the spirit of the present invention will be embraced in the present invention.

For example, in the embodiments, the hydraulic cylinders are used as the first to sixth actuators, but air cylinders, electric motors, or the like can be used in stead of them.

The entire contents of Japanese Patent Application No. 2004-000599 filed Jan. 5, 2004 is incorporated herein by reference.

What is claimed is:

1. An assembly device of a support mat for a ceramic catalyst carrier, comprising:

a base capable of holding the support mat in a flat plate shape substantially horizontally, the support mat having in both end portions a depression and a projection engageable with the depression, respectively;

a shaping die provided on an intermediate portion of said base and having a recession that has a shape substantially fitting a semicircular bottom surface of the ceramic catalyst carrier;

an automatic tape feeder to feed an adhesive tape to an upper surface of one end portion of said base;

a tape/support mat pressing unit that presses one end portion of the support mat toward the adhesive tape while the end portion of the support mat is placed on an upper surface of the adhesive tape, thereby sticking the adhesive tape to the end portion;

a tool base provided above said shaping die and driven by a first actuator to be vertically movable;

a push-in unit provided in said tool base and driven by a second actuator to be capable of pushing the ceramic catalyst carrier together with the support mat into the recession of said shaping die;

a first pressing unit and a second pressing unit that are provided in said tool base and that are driven by a third actuator and a fourth actuator to press both end portions of the support mat from side faces so as to curve the both end portions of the support mat along an arc-shaped upper surface of the ceramic catalyst carrier;

pressure rollers provided at tip portions of said first pressing unit and said second pressing unit respectively to be vertically turnable and biased by biasing members so as to press the both end portions of the support mat toward the ceramic catalyst carrier;

a tape presser that is independently disposed in an intermediate portion of said push-in unit and that is driven by a fifth actuator to press the adhesive tape to an upper surfaces of engagement portions of the depression and the projection of the support mat in a gap formed between said both pressure rollers and to operate concurrently with said push-in unit in pushing the ceramic catalyst carrier together with the support mat into the recession of said shaping die;

a push-up unit provided on a bottom of the recession of said shaping die and driven by a sixth actuator to be capable of pushing up the ceramic catalyst carrier together with the support mat; and a main body formed to have a substantial L-shaped cross section having a horizontal surface and a vertical surface.

2. The assembly device according to claim 1, wherein the base is fixedly positioned on the horizontal surface of the main body.

3. An assembly device of a support mat for a ceramic catalyst carrier, comprising:

a base capable of holding the support mat in a flat plate shape substantially horizontally, the support mat having in both end portions a depression and a projection engageable with the depression, respectively;

a shaping die provided on an intermediate portion of said base and having a recession that has a shape substantially fitting a semicircular bottom surface of the ceramic catalyst carrier;

an automatic tape feeder to feed an adhesive tape to an upper surface of one end portion of said base;

a tape/support mat pressing unit that presses one end portion of the support mat toward the adhesive tape while the end portion of the support mat is placed on a upper surface of the adhesive tape, thereby sticking the adhesive tape to the end portion;

a tool base provided above said shaping die and driving by a first actuator to be vertically movable;

a push-in unit provided in said tool base and driven by a second actuator to be capable of pushing the ceramic catalyst carrier together with the support mat into the recession of said shaping die;

a first pressing unit and a second pressing unit that are provided in said tool base and that are driven by a third actuator and a fourth actuator to press both end portions of the support mat from side faces so as to curve the both end portions of the support mat along an arc-shaped upper surface of the ceramic catalyst carrier;

pressure rollers provided at tip portions of said first pressing unit and said second pressing unit respectively to be vertically turnable and biased by biasing members so as to press the both end portions of the support mat toward the ceramic catalyst carrier;

a tape presser that is independently disposed in an intermediate portion of said push-in unit and that is driven by a fifth actuator to press the adhesive tape to an upper surfaces of engagement portions of the depression and the projection of the support mat in a gap formed between said both pressure rollers and to operate concurrently with said push-in unit in pushing the ceramic catalyst carrier together with the support mat into the recession of said shaping die; and a push-up unit provided on a bottom of the recession of said shaping die and driving an a sixth actuator to be capable of pushing up the ceramic catalyst carrier together with the support mat, wherein the upper surface of the base is formed as a flat surface to hold the support mast, wherein the upper surface of the base is formed as a flat surface to hold the support mat.

4. The assembly device according to claim 1, wherein the automatic tape feeder is fixedly positioned on the vertical surface of the main body.

5. The assembly device according to claim 3, wherein the upper surface of the base is made with an adhesion prevention material.

6. The assembly device according to claim 3, wherein the tape/support mat pressing unit is disposed at a right end portion of the base.

7. The assembly device according to claim 1, wherein the tool base moves vertically along the vertical surface of the main body.

8. The assembly device according to claim 1, further comprising a locking protrusion on the base for positioning the support mat.

9. The assembly device according to claim 1, further comprising positioning protrusions formed at corners of an upper periphery of an opening of the recession of the shaping die.

10. An assembly device of a support mat for a ceramic catalyst carrier, comprising:

a base capable of holding the support mat in a flat plate shape substantially horizontally, the support mat having in both end portions a depression and a projection engageable with the depression, respectively;

a shaping die provided on an intermediate portion of said base and having a recession that has a shape substantially fitting a semicircular bottom surface of the ceramic catalyst carrier;

an automatic tape feeder to feed an adhesive tape to an upper surface of one end portion of said base;

a tape/support mat pressing unit that presses one end portion of the support mat toward the adhesive tape while the end portion of the support mat is placed on a upper surface of the adhesive tape, thereby sticking the adhesive tape to the end portion;

a tool base provided above said shaping die and driving by a first actuator to be vertically movable;

a push-in unit provided in said tool base and driven by a second actuator to be capable of pushing the ceramic catalyst carrier together with the support mat into the recession of said shaping die;

a first pressing unit and a second pressing unit that are provided in said tool base and that are driven by a third actuator and a fourth actuator to press both end portions of the support mat from side faces so as to curve the both end portions of the support mat along an arc-shaped upper surface of the ceramic catalyst carrier;

pressure rollers provided at tip portions of said first pressing unit and said second pressing unit respectively to be vertically turnable and biased by biasing members so as to press the both end portions of the support mat toward the ceramic catalyst carrier;

a tape presser that is independently disposed in an intermediate portion of said push-in unit and that is driven by a fifth actuator to press the adhesive tape to an upper surfaces of engagement portions of the depression and the projection of the support mat in a gap formed between said both pressure rollers and to operate concurrently with said push-in unit in pushing the ceramic catalyst carrier together with the support mat into the recession of said shaping die; and a push-up unit provided on a bottom of the recession of said shaping die and driving an a sixth actuator to be capable of pushing up the ceramic catalyst carrier together with the support mat, wherein the upper surface of the base is formed as a flat surface to hold the support mast, wherein a lower surface of the push-in unit has an arc shape fining the arc-shaped upper surface of the ceramic catalyst carrier.

11. The assembly device according to claim 10, wherein the push-in unit is driven in a direction perpendicular to the tool base.

12. The assembly device according to claim 1, wherein pressure springs act as the biasing members.

13. The assembly device according to claim 3, further comprising a locking protrusion on the base for positioning the support mat.

14. The assembly device according to claim 3, further comprising positioning protrusions formed at corners of an upper periphery of an opening of the recession of the shaping die.

15. The assembly device according to claim 3, wherein pressure springs act as the biasing members.

16. The assembly device according to claim 10, further comprising a locking protrusion on the base for positioning the support mat.

17. The assembly device according to claim 10, further comprising positioning protrusions formed at corners of an upper periphery of an opening of the recession of the shaping die.

18. The assembly device according to claim 10, wherein pressure springs act as the biasing members.

* * * * *